US005725667A

United States Patent [19]

Petropoulos et al.

[11] Patent Number: 5,725,667

[45] Date of Patent: *Mar. 10, 1998

[54] DIP COATING APPARATUS HAVING A SINGLE COATING VESSEL

[75] Inventors: Mark C. Petropoulos, Ontario; Geoffrey M. T. Foley, Fairport; Eugene A. Swain, Webster; David J. Kilmer, Ontario; Mark S. Thomas, Williamson; Stanley J. Pietrzykowski, Jr.; Robert S. Foltz, both of Rochester; Peter J. Schmitt, Ontario; Richard P. Millonzi, Webster, all of N.Y.

[73] Assignee: Xerox Corporation, Stamford, Conn.

[ * ] Notice: The term of this patent shall not extend beyond the expiration date of Pat. No. 5,720,815.

[21] Appl. No.: 609,368

[22] Filed: Mar. 1, 1996

[51] Int. Cl.[6] ..... B05C 3/02; B05C 3/00; B05C 13/00; B05C 21/00

[52] U.S. Cl. ..... 118/407; 118/423; 118/429; 118/500

[58] Field of Search ..... 118/407, 423, 118/429, 500, 602, DIG. 12

[56] References Cited

U.S. PATENT DOCUMENTS

| | | | |
|---|---|---|---|
| 2,413,144 | 12/1946 | King | 117/63 |
| 3,557,749 | 1/1971 | Farago | 118/7 |
| 3,573,186 | 3/1971 | Ryerson et al. | 204/203 |
| 3,968,020 | 7/1976 | Nagano et al. | 204/203 |
| 4,152,467 | 5/1979 | Alpaugh et al. | 427/8 |
| 4,441,965 | 4/1984 | Matsumura et al. | 204/16 |
| 4,755,273 | 7/1988 | Bassett et al. | 204/299 |
| 4,967,777 | 11/1990 | Takayama et al. | 134/102 |
| 5,044,542 | 9/1991 | Deambrosio | 228/37 |
| 5,076,942 | 12/1991 | Goodman et al. | 210/791 |
| 5,162,291 | 11/1992 | Long et al. | 503/227 |
| 5,213,937 | 5/1993 | Miyake | 430/130 |
| 5,236,515 | 8/1993 | Ueno et al. | 134/25.4 |
| 5,244,697 | 9/1993 | Vackier et al. | 427/430.1 |
| 5,248,340 | 9/1993 | Nakagawa et al. | 118/422 |
| 5,279,916 | 1/1994 | Sumino | 430/134 |
| 5,334,246 | 8/1994 | Pietrzykowski, Jr. et al. | 118/69 |
| 5,415,966 | 5/1995 | Matsuura | 430/126 |
| 5,510,217 | 4/1996 | Hongo et al. | 430/58 |
| 5,521,047 | 5/1996 | Yuh et al. | 430/134 |

FOREIGN PATENT DOCUMENTS 0 415 865 3/1991 European Pat. Off. .

OTHER PUBLICATIONS

European Search Report for EP 97 30 1276.

Patent Abstracts of Japan, vol. 014, No. 150 (P-1025), Mar. 22, 1990 & JP 02 012155 A (Mita Ind Co Ltd), Jan. 17, 1990.

Patent Abstracts of Japan, vol. 012, No. 446 (C-546), Nov. 24, 1988 & JP 63 171669 A (Fuji Xerox Co Ltd), Jul. 15, 1988.

Patent Abstracts of Japan, vol. 018, No. 412 (P-1780), Aug. 2, 1994 & JP 06 123989 A (Matsushita Electric Ind Co Ltd), Jun. 5, 1994.

Patent Abstracts of Japan, vol. 017, No. 207 (P-1525), Apr. 22, 1993 & JP 04 346354 A (Konica Corp), Dec. 2, 1992.

*Primary Examiner*—Donald E. Czaja
*Assistant Examiner*—Jacqueline A. Ruller
*Attorney, Agent, or Firm*—Zosan S. Soong

[57] ABSTRACT

There is disclosed a dip coating apparatus including: (a) a single coating vessel capable of containing a batch of substrates vertically positioned in the vessel, wherein there is absent vessel walls defining a separate compartment for each of the substrates; (b) a coating solution disposed in the vessel, wherein the solution is comprised of materials employed in a photosensitive member and including a solvent that gives off a solvent vapor; and (c) a solvent vapor uniformity control apparatus which minimizes any difference in solvent vapor concentration encountered by the batch of the substrates in the air adjacent the solution surface, thereby improving coating uniformity of the substrates.

10 Claims, 6 Drawing Sheets

DIP COATING APPARATUS HAVING A SINGLE COATING VESSEL

CROSS REFERENCE TO RELATED APPLICATIONS

Attention is hereby directed to concurrently filed U.S. patent application Ser. No. 08/609,333 (D/96029) having the inventor, Eugene A. Swain, and titled "DIP COATING VESSEL HAVING SOLUTION DISPLACEMENT APPARATUS."

BACKGROUND OF THE INVENTION

This invention relates generally to a dip coating apparatus and more specifically to a dip coating apparatus for use in fabricating photosensitive members, wherein a large batch of substrates can be dip coated in a single coating vessel by incorporating a solvent vapor uniformity control apparatus.

Although the generic concept of dip coating a batch of substrates into a single coating vessel may not be unique, Xerox has traditionally employed in the field of photoreceptor fabrication a separate coating vessel for each substrate during dip coating in the belief that separate coating vessels minimize or eliminate potential problems which can create thickness nonuniformities in the coated layer. However, the use of separate coating vessels for each substrate significantly increases the cost as the substrate batch size increases. There is a need, which the present invention addresses, for lower cost dip coating equipment which can handle large batch sizes. The inventors have discovered that their concerns about solution turbulence affecting coating uniformity failed to materialize with the single coating vessel concept and that the use of a single coating vessel in fabricating a large batch of substrates is capable of furnishing acceptable quality photoreceptors provided there is incorporated a solvent vapor uniformity control apparatus.

The following patent documents may be relevant:

Pietrzykowski, Jr. et al., U.S. Pat. No. 5,334,246, discloses a dip coat process material handling system, the disclosure of which is hereby totally incorporated by reference;

Alpaugh et al., U.S. Pat. No. 4,152,467;

Matsumura et al., U.S. Pat. No. 4,441,965;

Takayama et al., U.S. Pat. No. 4,967,777;

Miyake, U.S. Pat. No. 5,213,937;

Ueno et al., U.S. Pat. No. 5,236,515; and

Sumino, U.S. Pat. No. 5,279,916.

SUMMARY OF THE INVENTION

The present invention is accomplished in embodiments by providing a dip coating apparatus comprising:

(a) a single coating vessel capable of containing a batch of substrates vertically positioned in the vessel, wherein there is absent vessel walls defining a separate compartment for each of the substrates;

(b) a coating solution disposed in the vessel, wherein the solution is comprised of materials employed in a photosensitive member and including a solvent that gives off a solvent vapor; and (c) a solvent vapor uniformity control apparatus which minimizes any difference in solvent vapor concentration encountered by the batch of the substrates in the air adjacent the solution surface, thereby improving coating uniformity of the substrates.

In additional embodiments of the present invention, there is also provided a dip coating apparatus comprising:

(a) a single coating vessel capable of containing a batch of substrates vertically positioned in the vessel, wherein there is absent vessel walls defining a separate compartment for each of the substrates;

(b) a coating solution disposed in the vessel, wherein the solution is comprised of materials employed in a photosensitive member and including a solvent that gives off a solvent vapor; and (c) a solution displacement apparatus positioned in the vessel to reduce the volume of solution required for dip coating the substrates.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

The single coating vessel is also referred herein as a bathtub tank or tank.

Figure 1:
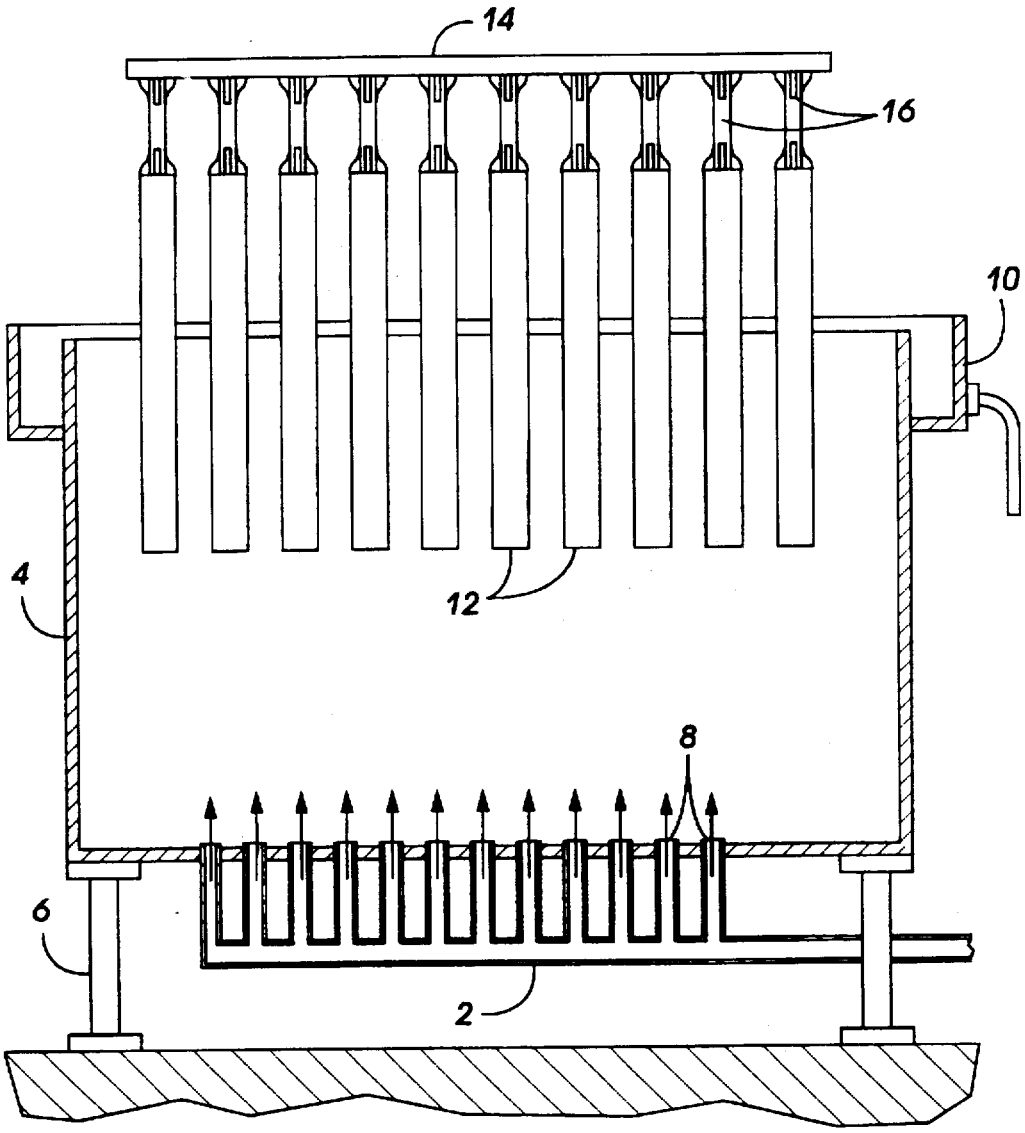
FIG. 1 represents a schematic, cross-sectional side view of the present dip coating apparatus wherein the manifold assembly is located outside the coating vessel.

FIG. 1 illustrates an embodiment of the present invention where the manifold assembly 2 is positioned outside the single coating vessel 4. The vessel 4 is supported by support 6. Solution is pumped into the vessel through the bottom of the vessel via the manifold assembly 2 having fluid outlets 8. There may be for example 8 to 15 fluid outlets per manifold assembly. The number of manifold assemblies may range from 3 to 10, depending for instance upon the vessel size. The manifold assembly and the fluid outlets evenly distribute the solution into the vessel. The solution which flows over the sides of the vessel enters the overflow area 10 and can be returned to the vessel via a connection with a suitable pump to the manifold assembly. FIG. 1 also shows a batch of substrates 12 which are conveyed on carrier pallet 14 to the vessel. The carrier pallet 14 has a plurality of chuck assemblies 16 which hold the substrates 12. The carrier pallet enables the batch of the substrates to be moved into and out of the vessel substantially simultaneously, preferably simultaneously.

Any suitable chuck assembly can be used to hold the substrates including the chuck assemblies disclosed in Mistrater et al., U.S. Pat. No. 5,320,364, and Swain et al., U.S. application Ser. No. 08/395,214 (D/94641), the disclosures of which are hereby totally incorporated by reference.

The substrate batch size may range for example from about 10 to about 400 substrates, preferably from about 100 to about 300 substrates. In certain embodiments, the batch size is at least about 14 substrates. The spacing between substrate peripheries (based on the closest distance between the outer surfaces of adjacent substrates) can be from about 20 mm to about 200 mm, preferably from about 30 mm to about 150 mm, and more preferably from about 30 mm to about 100 mm. The substrates may be moved into and out of the solution at any suitable speed including the take-up speed indicated in Yashiki et al., U.S. Pat. No. 4,610,942, the disclosure of which is hereby totally incorporated by reference. The present invention encompasses the following dip coating techniques to deposit layered material onto the substrates: moving the substrates into and out of the solution; raising and lowering the coating vessel to contact the solution with the substrates; and while the substrates are positioned in the coating vessel filling the vessel with the solution and then draining the solution from the vessel.

Figure 2:
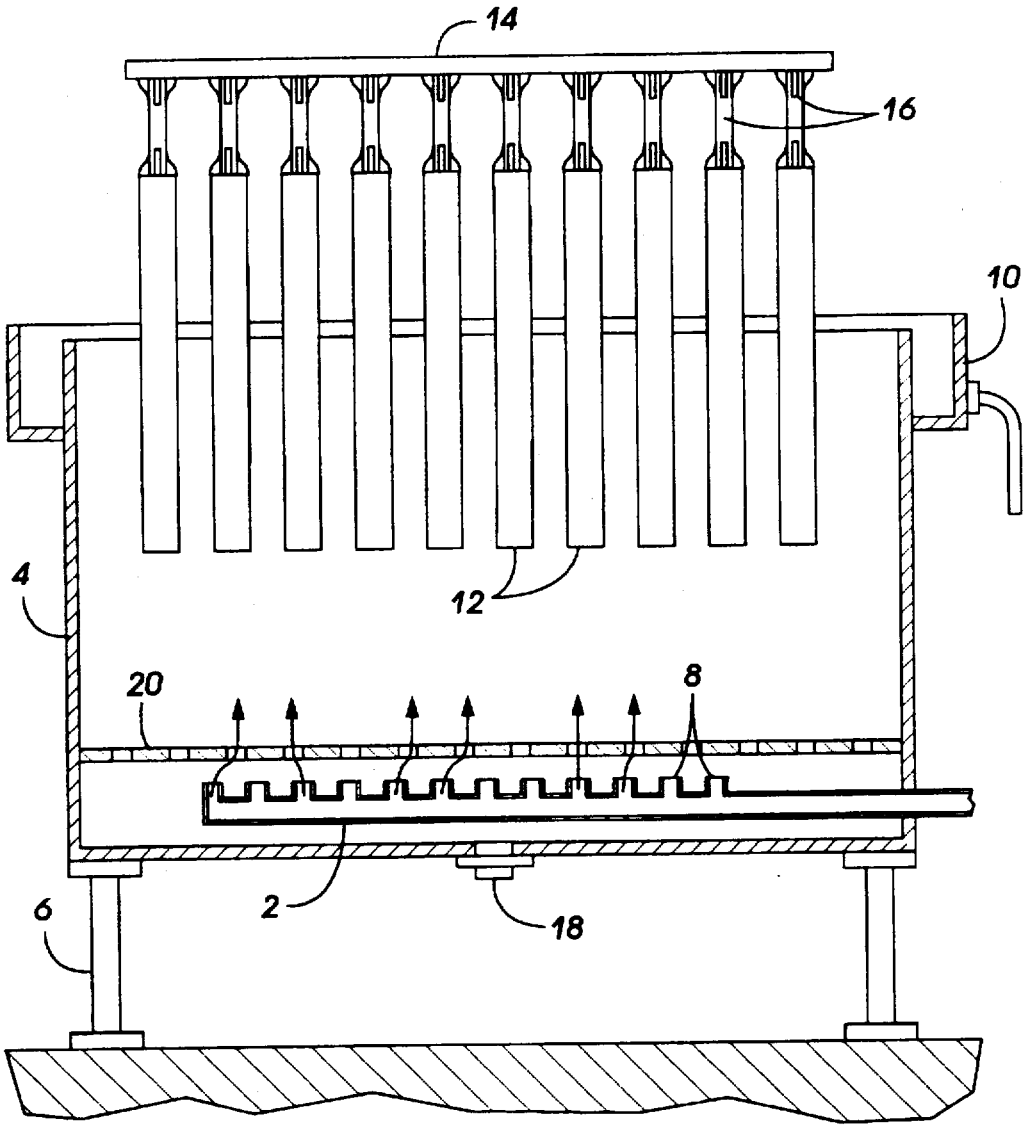
FIG. 2 represents a schematic, cross-sectional side view of another embodiment wherein the manifold assembly is located inside the coating vessel.

FIG. 2 illustrates another embodiment of the present invention where the manifold assembly 2 having the fluid outlets 8 is positioned inside the vessel 4. A drain 18 may be provided which is coupled to a solution storage tank (not shown), whereby solution is drained from the vessel and stored for future use. The embodiment of FIG. 2 reduces the cost of the bathtub tank as well as greatly reducing the cleaning and maintenance time. The number of connections is reduced and this design allows flexibility in the number and configuration of the manifold assemblies and the fluid outlets to accommodate various fluid distribution schemes that affect shear and other rheological properties. A perforated manifold assembly may be used which consists of many small holes uniformly placed. Also, the fluid outlets in the manifold assembly need not only face upward; some could face downward or laterally. The embodiment of FIG. 2 also allows for an optional perforated fluid distribution plate 20 to be used to further change the fluid flow characteristics if desired.

The bathtub tank may be fabricated from any suitable material and may have any suitable dimensions and shape. Preferred materials for the tank include stainless steel, plastic, copper, steel, and the like. The shape of the tank can be round, oval, or rectangular. The size of the tank is dependent upon the number of substrates to be coated but in preferred embodiments is approximately 415 mm wide by 1075 mm long by 510 mm deep.

Figure 3:
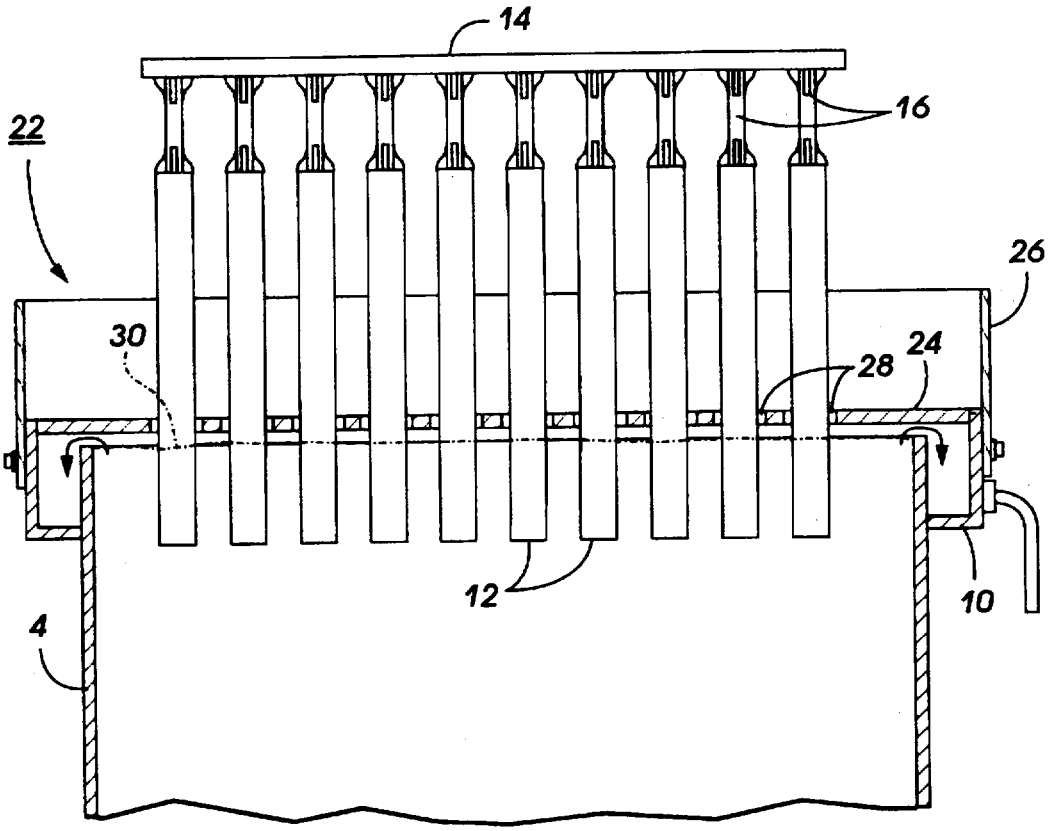
FIG. 3 represents a schematic, cross-sectional side view of one embodiment of the solvent vapor uniformity control apparatus incorporated into the present dip coating apparatus.

FIG. 3 describes in more detail the solvent vapor uniformity control apparatus 22 operatively associated with the vessel 4. The solvent vapor uniformity control apparatus 22 preferably includes one or both of the following: a plate 24 defining a plurality of holes 28 for passage of the substrates through the plate during dip coating and a draft shield 26 disposed around the vessel. The number of holes 28 in plate 24 preferably corresponds to the number of substrates in the batch. In FIG. 3, the plate 24 is positioned adjacent the solution surface 30 at a distance ranging for example from about 1 to about 8 cm, and preferably from about 3 to about 5 cm and is suspended from the vertical sides of the overflow area 10. In FIG. 3, the plate 24 extends over a substantial portion of the solution surface in the vessel, such as from about 70% to 100% of the solution surface, and preferably over the entire solution surface. The plate can also extend over the sides of the vessel to cover the overflow area 10. The plate, being suspended slightly above the solution surface, causes a uniform saturated solvent vapor concentration to form across the entire surface of the tank within this space. Preferred materials for the plate include stainless steel, anodized aluminum, plastic, and the like. In preferred embodiments, the plate covers the entire tank except for the openings through which the substrates pass. The spacing between the substrate and the edge of the hole is determined as a percentage of the diameter of the substrate and may be for example from about 5 to about 50%, preferably from about 10 to about 40%, and more preferably from about 12 to about 30%.

In FIG. 3, the draft shield 26 is positioned around the perimeter of the vessel 4 at the top of the vessel. The draft shield is attached to the vertical wall of the overflow area 10. The height of the draft shield may be for example from about 5 mm to about 200 mm, preferably from about 50 mm to about 150 mm, and more preferably from about 70 mm to 100 mm. The draft shield is preferably made from stainless steel, aluminum, or plastic. In embodiments, there may be a plurality of holes in the draft shield to allow solvent vapor to escape at a controlled rate; for example, the draft shield may incorporate fine mesh screen in its walls to control the concentration of the solvent vapor. The walls of the draft shield may be vertical or slanted such as slanted inwardly towards the center of the tank. The draft shield is used to prevent air currents from causing ripples in the solution surface which in turn causes coating nonuniformities. The draft shield also helps trap the solvent vapor above the solution surface and helps maintain a vertically uniform concentration of solvent vapor through which the substrates move as they are withdrawn from the tank. As the substrates are withdrawn from the tank, the solvent vapor concentration increases as the wet surface exposure increases and is believed to reach a concentration of from about 40 to about 60% of saturation. In the absence of the draft shield, the solvent vapor would be less dense at the fringes of the tank, thereby causing the coating thickness of those substrates at the fringes of the tank to be different from the coating thickness of the substrates at the center of the tank.

Figure 4:
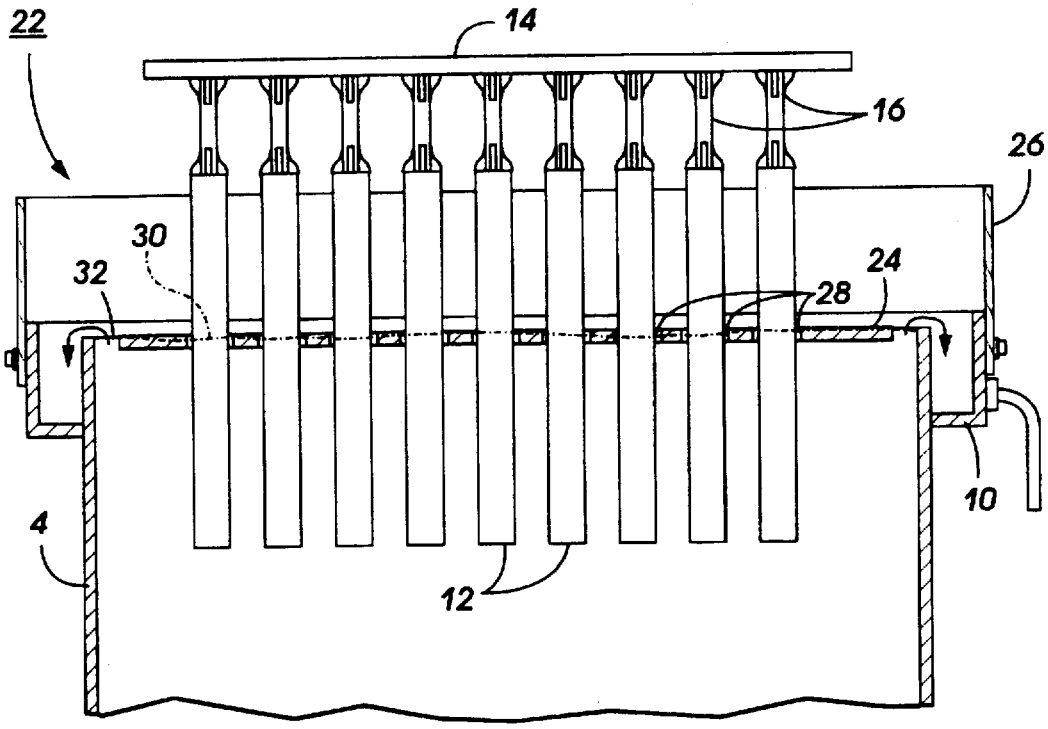
FIG. 4 represents a schematic, cross-sectional side view of another embodiment of the solvent vapor uniformity control apparatus incorporated into the present dip coating apparatus.

FIG. 4 discloses another embodiment of the present invention where the plate 24 defining holes 28 is partially immersed in the solution (the solution surface is indicated by 30) with the dip coating of the substrates taking place through the holes in the plate. The plate 24 may be immersed in the solution at a depth ranging for example from about 25% to 80% of the plate thickness. Preferably, there is a gap 32 between the side edge of the plate 24 and the vessel sides to allow for overflow of the solution into the overflow area 10. The plate is held in position by suspending it from the vertical walls of the overflow area 10. Preferred materials for the plate are Teflon or stainless steel, but other solvent resistant materials can be used. The plate may cover the entire surface of the tank except for example about 10 mm around the edge which allows for overflow. The holes which the substrates pass through have a size that is determined as described herein. Since the plate is partially immersed in the solution, the plate greatly reduces the surface area of the solution and therefore the vapor concentration and the rate of evaporation of the solution components such as the solvent. A possible disadvantage of partially immersing the plate in the solution is that there may be a tendency to trap contaminants since there is no lateral solution surface flow. This potential disadvantage can be eliminated by lifting the plate free of the solution surface for a brief time after each dip coating cycle. This can be easily automated for a manufacturing system.

The plate 24 illustrated in FIGS. 3–4 reduces the solution surface area to an amount ranging for example from about 20% to about 80% and preferably from about 30% to about 60%, relative to the solution surface area in the absence of the plate. This reduction in solution surface area is dependent on the diameter of the substrates which are being coated. In the absence of the plate, localized coating solution circulation cells form which are generated by the rapid evaporation of solvents from the surface resulting in rings of nonuniform thickness along the length of the substrate.

Figure 5:
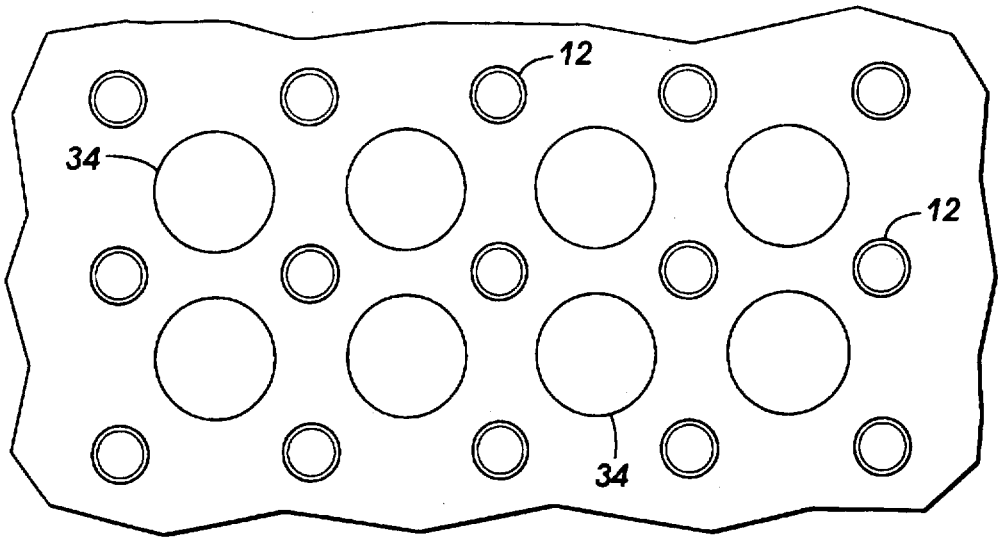
FIG. 5 represents a schematic top view of one embodiment of the solution displacement apparatus incorporated into the present dip coating apparatus.
Figure 6:
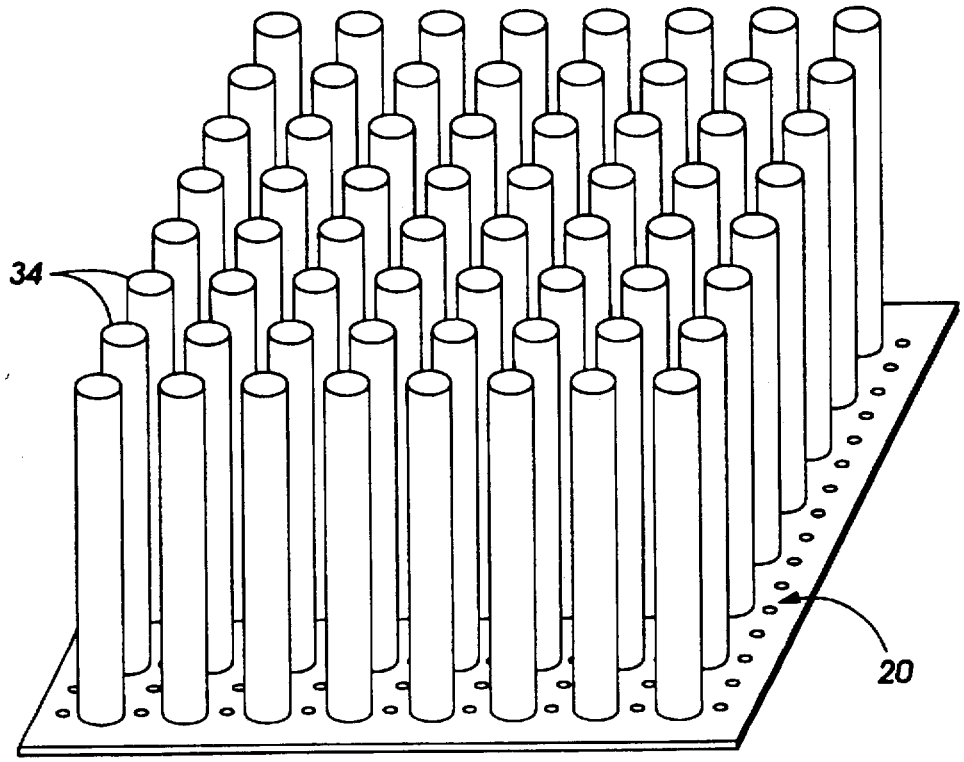
FIG. 6 represents a schematic, perspective view of the solution displacement apparatus of FIG. 5.

FIGS. 5–6 illustrate one embodiment of a solution displacement apparatus comprising a plurality of sealed vertically oriented members 34 interspersed into the spaces among the substrates 12 in the coating vessel. The sealed members may range in number for example from about 10 to about 400, and preferably from about 50 to about 200. The sealed members may have any suitable shape such as cylindrical, rectangular, triangular, and the like. Preferably, the sealed members 34 extend vertically upward from the vessel bottom and end at a position slightly below the solution surface such as 10 mm below the solution surface. The sealed members may be disposed on the same center to center spacing as the substrates to be coated. The cross-sectional dimension of the sealed members is dependent upon the diameter of the substrates to be coated, but the sealed members preferably displace a significant percentage of the volume between adjacent substrates. The sealed members may be arranged in a regular pattern forming for example evenly spaced rows and columns. The sealed members can be mounted to a perforated fluid distribution plate 20, wherein the plate is fastened to the bottom of the vessel 4 just above the fluid outlets 8 of the manifold assembly 2. The solution flows through the holes of the fluid distribution plate and then vertically upward along the sealed members. The sealed members may act as a solution flow straightener and may reduce turbulent flow.

Figure 7:
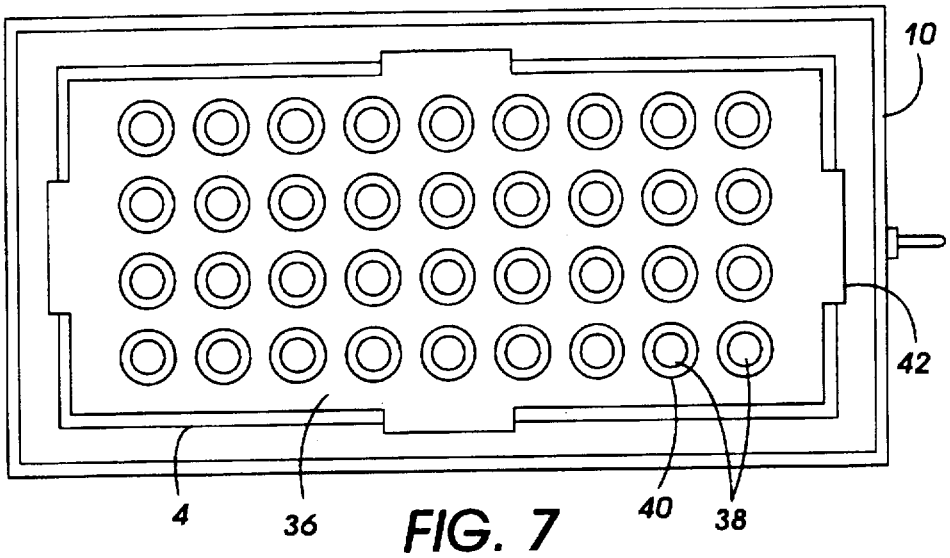
FIG. 7 represents a schematic top view of another embodiment of the solution displacement apparatus incorporated into the present dip coating apparatus.
Figure 8:
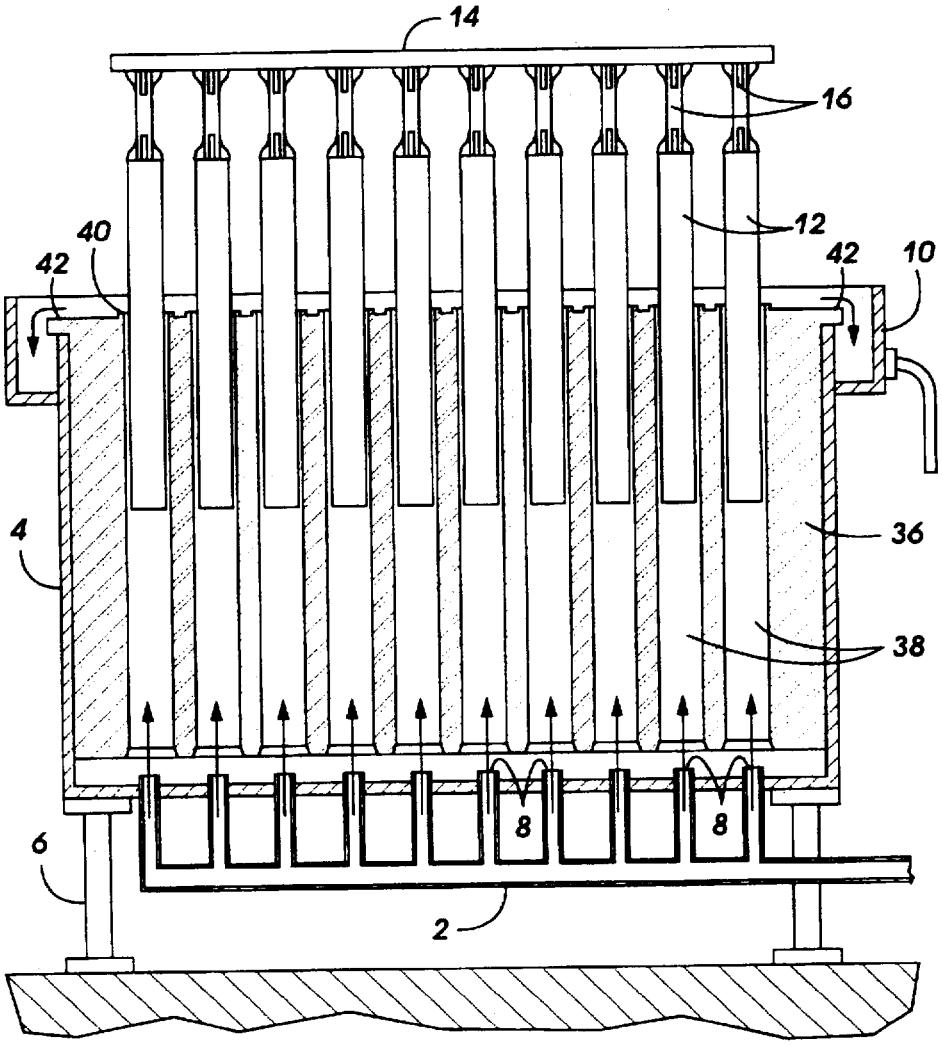
FIG. 8 represents a schematic, cross-sectional side view of the embodiment of FIG. 7.

FIGS. 7–8 illustrate another embodiment of the solution displacement apparatus comprising an insert 36 placed into the vessel 4. The insert 36 defines substrate compartments 38, preferably one compartment for each substrate. Preferably, the portions of the top surface of the insert surrounding each compartment opening is a raised area 40 to facilitate solution overflow into the overflow area 10. A plurality of side supports 42, such as four side supports, contacts the rim of the vessel 4 thereby allowing the insert to rest against the vessel. The open bottom end of each compartment is positioned adjacent a fluid outlet 8 of the manifold assembly 2. The compartments 38 may be of any suitable dimensions to accommodate the substrates. At least a substantial portion of the substrate is positioned within the compartment such as for example about 60% to 100% of the length of the substrate during dip coating. The insert may be a single piece or several pieces joined together. The insert may be molded or cut from a block of material. Preferred insert materials include a plastic such as Teflon. Different insert designs allow for solution flow variability.

The solution displacement apparatus of the present invention may reduce the solution volume required for dip coating by for example from about 30% to about 70%. For example, in one embodiment, the bathtub tank may require about 85 gallons of the solution in the absence of the solution displacement apparatus; in contrast, the bathtub tank requires only about 50 gallons of the solution by using the solution displacement apparatus described herein. Thus, by using the solution displacement apparatus, large amounts of solution volume can be displaced resulting in reduced cost and much easier handling of the solution.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 10 centimeters, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like. The substrates preferably have a hollow, endless configuration.

The coating solution may comprise materials typically used for any layer of a photosensitive member including such layers as a subbing layer, a charge barrier layer, an adhesive layer, a charge transport layer, and a charge generating layer, such materials and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference. In embodiments, the coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. The coating solution may also contain an organic solvent such as one or more of the following: tetrahydrofuran, monochlorobenzene, and cyclohexanone. An illustrative charge transport layer coating solution has the following composition: 10% by weight N,N'-diphenyl-N,N'-bis(3-methylphenyl)- [1,1'-biphenyl]-4,4'diamine; 14% by weight poly(4,4'-diphenyl-1,1'-cyclohexane carbonate (400 molecular weight); 57% by weight tetrahydrofuran; and 19% by weight monochlorobenzene. A representative charge generating material coating solution comprises: 2% by weight hydroxy gallium phthalocyanine; 1% by weight terpolymer of vinyl acetate, vinyl chloride, and maleic acid; and 97% by weight cyclohexanone.

The present invention also encompasses the use of one, two, or more additional bathtub tanks, along with their corresponding solvent vapor uniformity control apparatus, to hold different coating solutions, whereby the various layers of a photosensitive member can be formed in succession on a batch of substrates.

Other modifications of the present invention may occur to those skilled in the art based upon a reading of the present disclosure and these modifications are intended to be included within the scope of the present invention.

We claim:

1. A dip coating apparatus comprising:

(a) a single coating vessel capable of containing a batch of substrates vertically positioned in the vessel, wherein there is absent vessel walls defining a separate compartment for each of the substrates;

(b) a coating solution disposed in the vessel, wherein the solution is comprised of a solvent that gives off a solvent vapor and a material selected from the group consisting of a charge generating material and a charge transport material; and (c) a solvent vapor uniformity control apparatus which minimizes any difference in solvent vapor concentration encountered by the batch of the substrates in the air adjacent the solution surface, thereby improving coating uniformity of the substrates.

2. The apparatus of claim 1, wherein the batch of substrates ranges from about 10 to about 400.

3. The apparatus of claim 1, wherein the batch of substrates ranges from about 100 to about 300.

4. The apparatus of claim 1, wherein the solvent vapor uniformity control apparatus comprises a plate defining a plurality of holes for passage of the substrates through the plate.

5. The apparatus of claim 4, wherein the plate is disposed above the solution surface.

6. The apparatus of claim 4, wherein the plate is partially immersed in the solution.

7. The apparatus of claim 4, wherein the solvent vapor uniformity control apparatus further comprises a draft shield disposed around the vessel.

8. The apparatus of claim 1, further comprising a solution displacement apparatus disposed in the vessel, wherein the solution displacement apparatus is comprised of an insert defining a plurality of compartments.

9. The apparatus of claim 1, wherein the solvent vapor uniformity control apparatus comprises a draft shield disposed around the vessel.

10. The apparatus of claim 1, wherein the substrates have a hollow, endless configuration.

* * * * *